US009303450B2

(12) United States Patent
Anderson et al.

(10) Patent No.: US 9,303,450 B2
(45) Date of Patent: Apr. 5, 2016

(54) PARALLEL BAR CORDING FOR MOVABLE RAILS

(71) Applicant: Hunter Douglas Inc., Pearl River, NY (US)

(72) Inventors: Richard Anderson, Whitesville, KY (US); Eugene W. Thompson, Maceo, KY (US); Steven R. Haarer, Maceo, KY (US)

(73) Assignee: Hunter Douglas Inc., Pearl River, NY (US)

( * ) Notice: Subject to any disclaimer, the term of this patent is extended or adjusted under 35 U.S.C. 154(b) by 59 days.

(21) Appl. No.: 13/854,333

(22) Filed: Apr. 1, 2013

(65) Prior Publication Data

US 2013/0299103 A1 Nov. 14, 2013

Related U.S. Application Data

(60) Provisional application No. 61/645,250, filed on May 10, 2012.

(51) Int. Cl.

| | |
|---|---|
| ***E06B 9/06*** | (2006.01) |
| ***E06B 9/24*** | (2006.01) |
| ***E06B 9/322*** | (2006.01) |

(52) U.S. Cl.

CPC . *E06B 9/24* (2013.01); *E06B 9/322* (2013.01); *E06B 2009/3222* (2013.01)

(58) Field of Classification Search

CPC ..... E06B 3/48; E06B 9/262; E06B 9/24; E06B 9/322; E06B 2009/3222

USPC ..... 160/84.06, 84.05, 115, 170, 172 R, 160/178.2

See application file for complete search history.

(56) References Cited

U.S. PATENT DOCUMENTS

| | | | | |
|---|---|---|---|---|
| 4,202,395 | A | 5/1980 | Heck et al. | |
| 4,825,929 | A * | 5/1989 | Haines | 160/84.06 |
| 5,535,806 | A * | 7/1996 | Kold et al. | 160/273.1 |
| 6,056,036 | A | 5/2000 | Todd et al. | |
| 6,338,378 | B1 * | 1/2002 | Kold | 160/279 |
| 6,675,861 | B2 * | 1/2004 | Palmer et al. | 160/170 |
| 6,725,897 | B2 * | 4/2004 | Palmer | 160/168.1 R |
| 7,108,038 | B2 * | 9/2006 | Welfonder | 160/84.06 |
| 2003/0111190 | A1 | 6/2003 | Palmer et al. | |
| 2004/0016513 | A1 * | 1/2004 | Hung | 160/84.06 |
| 2004/0159410 | A1 * | 8/2004 | Welfonder | 160/84.06 |
| 2013/0299103 | A1 * | 11/2013 | Anderson et al. | 160/331 |
| 2014/0076504 | A1 * | 3/2014 | Anthony et al. | 160/84.04 |

FOREIGN PATENT DOCUMENTS

| | | |
|---|---|---|
| EP | 0558154 | 9/1993 |

* cited by examiner

*Primary Examiner* — Blair M Johnson

(74) *Attorney, Agent, or Firm* — Camoriano & Associates

(57) ABSTRACT

A covering for an architectural opening has a horizontal movable rail supported by cords, with a variety of configurations, some of which prevent the horizontal movable rail from skewing, most of which conceal the cords.

10 Claims, 7 Drawing Sheets

PARALLEL BAR CORDING FOR MOVABLE RAILS

BACKGROUND OF THE INVENTION

This application claims priority from U.S. Provisional Application Ser. No. 61/645,250 filed May 10, 2012.

The present invention relates to an arrangement for opening and closing coverings for architectural openings such as pleated shades and cellular shades.

Usually, a transport system for a covering that extends and retracts in the vertical direction has a fixed head rail which both supports the covering and hides the mechanisms used to raise and lower or extend and retract the covering. Such a transport system is described in U.S. Pat. No. 6,536,503, Modular Transport System for Coverings for Architectural Openings, which is hereby incorporated herein by reference. In the typical covering product that retracts at the top and then extends by moving downwardly from the top (top/down), the extension and retraction of the covering is done by lift cords suspended from the head rail and attached to the bottom rail (also referred to as the moving rail or bottom slat).

Some window covering products are built to operate in the reverse (bottom-up), where the moving rail, instead of being at the bottom of the window covering bundle, is at the top of the window covering bundle, between the bundle and the head rail, such that the bundle is normally accumulated at the bottom of the window when the covering is retracted and the moving rail is at the top of the window covering, next to the head rail, when the covering is extended. There are also composite products which are able to do both, to go top-down and/or bottom-up. Sometimes there is a problem with the movable rail(s) becoming skewed.

SUMMARY OF THE INVENTION

The present invention provides an arrangement for moving a covering from one position to another which has advantages over prior art cord drives, eliminating many of their problems, such as eliminating loose lift cords. Some embodiments disclose the path, or routing, or "cording" of cables to prevent the movable rails from skewing.

DESCRIPTION

Figure 1:
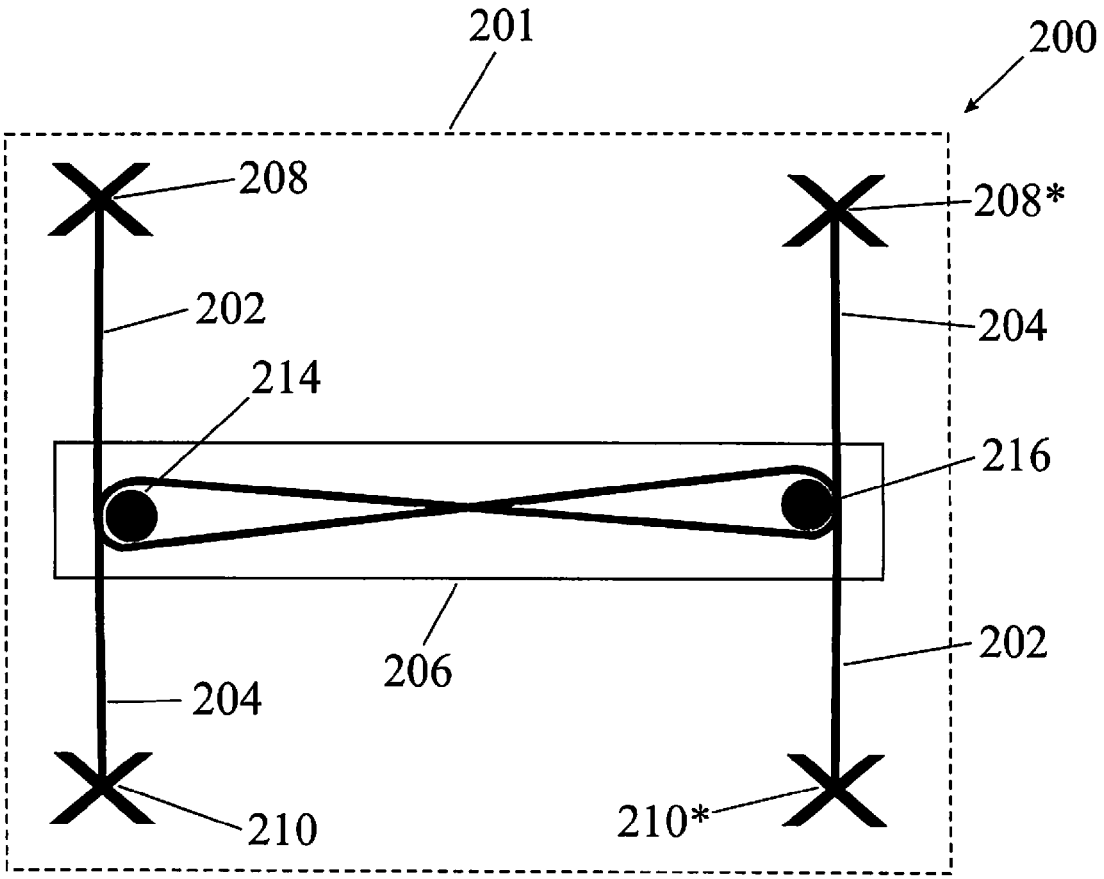
Prior Art FIG 1
FIG. 1 is a schematic of a prior art cording arrangement for a movable rail in which the movable rail moves along two cords that are secured, at their top and bottom ends, to the frame of an architectural opening.

FIG. 1 schematically illustrates a prior art blind or shade 200 with a movable rail 206, which travels along first and second guide cables 202, 204. The first guide cable 202 extends from an upper anchoring point 208 at the top left of the architectural opening 201, under a bearing support 214 at the left end of the movable rail 206, to the right end of the movable rail 206, over a bearing support 216 at the right end of the movable rail 206, to a lower, fixed anchoring point 210* at the bottom right of the architectural opening 201. The second guide cable 204 extends from an upper anchoring point 208* at the top right of the architectural opening 201, under a bearing support 216 at the right end of the movable rail 206, to the left end of the movable rail 206, over a bearing support 214 at the left end of the movable rail, to a lower, fixed anchoring point 210 at the bottom left of the architectural opening 201. The cables 202, 204 are kept taut by an elastic member, which may also be referred to as an elastic tensioning member. For example, the cables 202, 204 themselves may be made of an elastic member (an elastic tensioning member), or there may be springs (elastic tensioning members) (not shown) between the ends of the cables 202, 204 and their anchor points 208, 208*, which act to keep the cables 202, 204 taut, resulting in a system frictional force that is sufficient to keep the movable rail 206 from falling when released by the user. The left and right bearing supports 214, 216 may be rotatable members, such as pulleys, but they are fixed on the movable rail 206, so their relative positions along the movable rail 206 (i.e. their axes of rotation) are fixed. (The architectural opening 201 shown here is rectangular, but it could have any desired shape. Also, while the schematic shows both cords using the same bearing supports 214, 216, there actually are separate bearing supports for each cord.)

The upper anchoring points 208, 208* may represent tying the first ends of the first and second guide cables 202, 204 to a window frame, to a fixed head rail, or to some other point that is fixed relative to the opening 201. Likewise, the lower fixed anchoring points 210, 210* may represent tying off of the second ends of the first and second guide cables 202, 204 to the bottom of a window frame, to a fixed bottom rail, or to some other points fixed relative to the opening 201. A covering material, such as a blind or shade, may extend from the top of the opening 201 (or from the top anchoring points 208, 208*) to the movable rail 206, or from the movable rail 206 to the bottom of the opening 201 (or to the bottom anchoring points 210, 210*), or there may be two covering materials, with the first covering material extending from the top of the opening 201 to the movable rail 206 and the second covering material extending from the movable rail 206 to the bottom of the opening 201.

This arrangement is known in the prior art and is used, for instance, in shades for recreational vehicles. As described earlier, these arrangements require the first and second cables 202, 204 to be very taut so that, when the user moves the movable rail 206 and then releases it, there is enough system friction to hold the movable rail 206 in place.

The purpose of the cording arrangement shown in FIG. 1 is to keep the movable rail 206 horizontal (that is, so that it cannot skew). This is accomplished because the guide cables 202, 204 have a fixed length. If the user pulls down on the left end of the movable rail 206, causing the length of the first cable 202 between the upper fixed point 208 and the left bearing support 214 to increase, then the length of the first cable 202 between the left bearing support 214 and the bottom fixed point 210* must decrease a corresponding amount. This causes the right bearing support 216 to move downwardly the same distance as the left bearing support 214, thereby keeping the movable rail 206 horizontal. (This arrangement may be referred to as horizontal cording).

Figure 2:
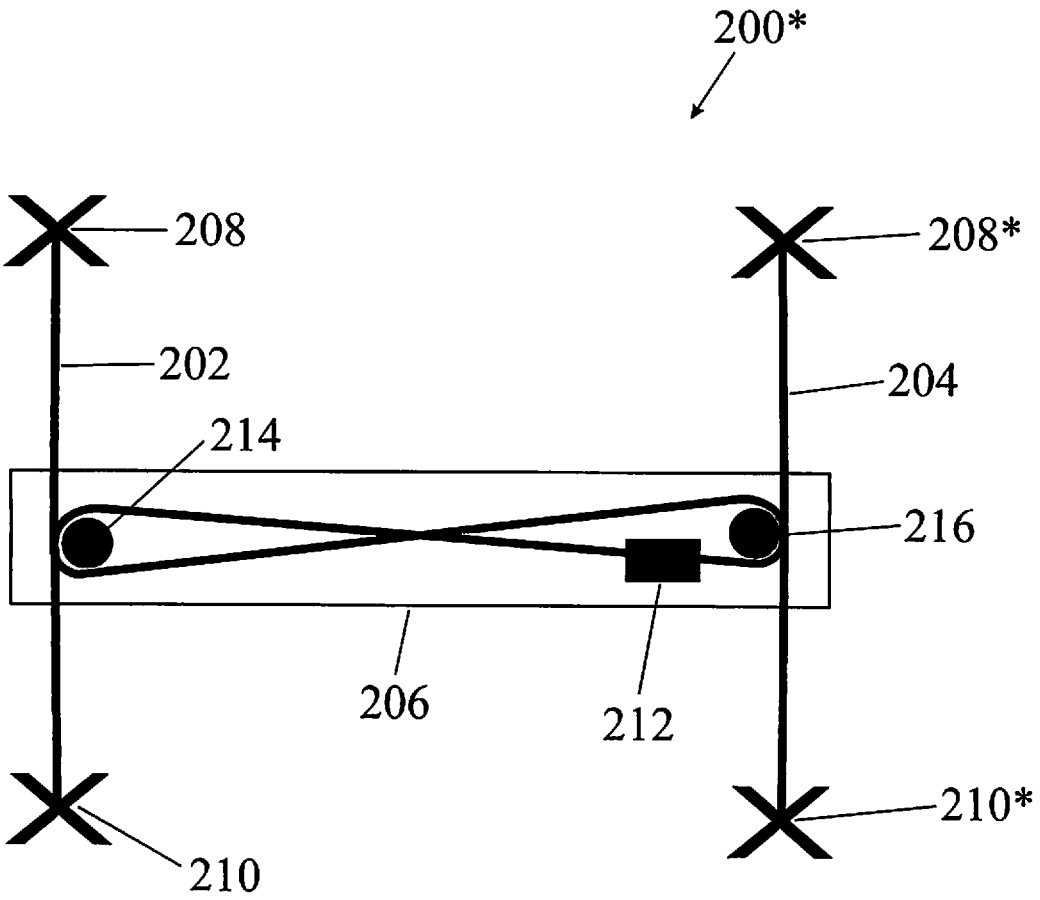
FIG. 2 is a schematic similar to FIG. 1, but with the addition of a one way brake and the use of non-stretch cables.

Referring now to FIG. 2, this cording is substantially identical to the horizontal cording of FIG. 1, except that the first and second guide cables 202, 204 are not kept taut by an elastic biasing means. Since the cables 202, 204 are no longer as taut, friction is greatly reduced and is no longer sufficient to hold the movable rail 206 in place when it is released by the user. Instead, a brake 212 is used to prevent the movable rail 206 from falling. The guide cables 202, 204 are fixedly secured to their respective anchoring points 208, 208*, 210, 210* and still travel over and under the bearing supports 214, 216 as in the previous embodiment. However, because the guide cables 202, 204 are not as tight between their respective top and bottom anchoring points, the operating force required to raise and lower the blind 200* is reduced. These cables 202, 204 still are taut, in that they do not have slop or slack, but not so taut that the cables provide enough friction to prevent the movable rail 206 from falling without the aid of the brake 212.

Various types of brakes are known and could be used here. (For the purposes of this application, a brake can be distinguished from general system friction in that a brake includes a mechanism that allows the user to release the braking force, so the user does not have to act against the force of the brake to extend and retract the covering. Various types of release mechanisms are well known in the art, such as a button or lever acting against a biasing spring force, a pivoting dog brake with teeth that pivots in one direction to pinch the cord against a fixed surface and pivots in the opposite direction to release the cord, a capstan brake arrangement in which a release mechanism allows the capstan to rotate, a clutch brake with a release mechanism, and various other known brakes with various release mechanisms.)

Figure 7:
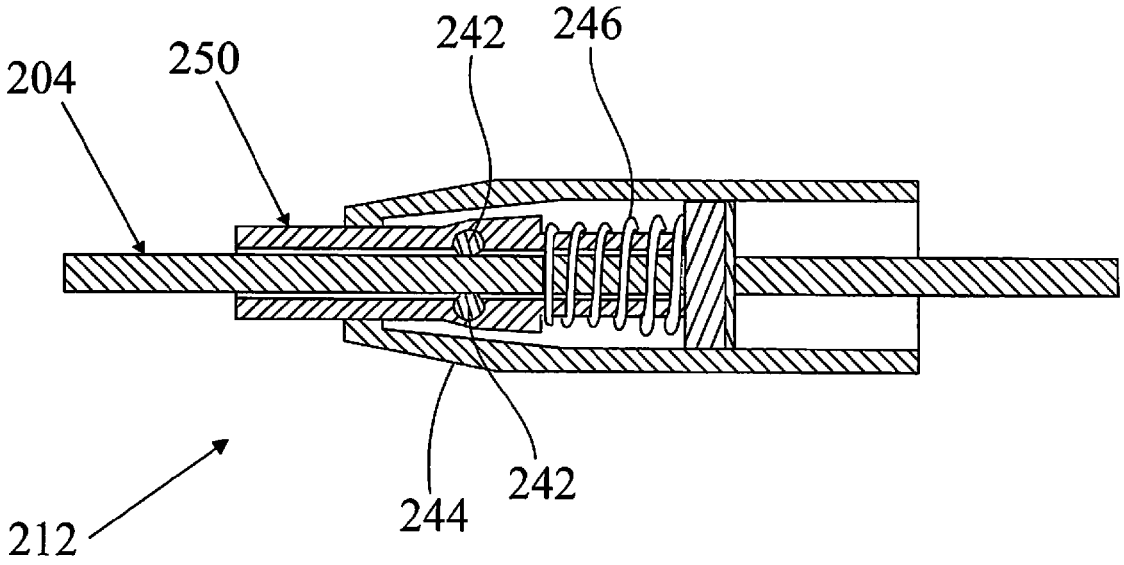
FIG. 7 is a section view of a one-way cable clamp lock mechanism which may be used in the embodiments shown in FIGS. 2, 3, 4, 5, and 6.

In this particular embodiment 200*, a one-way brake 212 is used, and this particular one-way brake is a one-way cable clamp lock mechanism, similar to the off-the-shelf item supplied by GripLock systems, as shown in FIG. 7. The one-way brake 212 is arranged so that it provides very little resistance to the cable 204 passing from left to right through the brake 212, which corresponds to raising the movable rail 206, but it stops the cable 204 from moving from right to left through the brake 212, which corresponds to lowering the movable rail 206 (or to the movable rail 206 falling).

It should be noted that the brake 212 only applies a braking force to one guide cable 204. The brake 212 does not apply a braking force to the other guide cable 202.

Looking now at FIG. 7, which shows the details of the one-way brake 212, the housing 244 of the brake 212 is fixed relative to the movable rail 206. The housing 244 has a generally cylindrical, tubular shape, except that the inside surface tapers to a smaller diameter at the left end. A plunger 250 also has a generally cylindrical, tubular shape, is coaxial with the housing 244, and moves in and out longitudinally along its axis relative to the housing, with the left end of the plunger 250 projecting out beyond the left end of the housing 244. Three ball bearings 242 are housed in the plunger 250, and, as the plunger moves to the left, and the inside diameter of the housing 244 decreases, the ball bearings 242 are pushed inwardly, causing the ball bearings 242 to grip the cable 204 that extends through the plunger 250 and the housing 244 so the cable 204 stops moving relative to the housing 244 and relative to the movable rail 206, which stops the movable rail 206.

A biasing spring 246 biases the plunger 250 to the left, so the brake 212 is normally locked. However, when the user grabs the movable rail 206 and raises it upwardly, the cable 204 drags the plunger 250 to the right, against the force of the spring 246, which greatly reduces the force of the ball bearings 242 on the cable 204, thereby releasing the braking force, so the cable 204 can travel freely from left to right through the one-way brake 212.

If the user wants to lower the movable rail 206, he can push in on the plunger 250, moving it to the right, against the biasing force of the spring 246, which releases the lock 212, allowing the cable 248 to move freely in either direction.

Of course, the one-way brake 212 could be replaced by a two-way brake, which would require the user to disengage the brake both to raise and to lower the movable rail 206. However, in the embodiment shown in FIG. 2, which has a one-way brake, the user only needs to push on the plunger to release the brake 212 when pulling down on the movable rail 206. The user may raise the movable rail 206 by pushing up on the movable rail 206 anywhere along the length of the movable rail 206, without having to handle the brake 212.

Due to the natural "horizontal bias" of the horizontal cording of FIG. 2, the movable rail 206 will always remain horizontal, no matter where the user applies force to raise or lower the rail 206. The user will then be raising the rail 206 against the minimal drag of the one-way brake 212 in the non-braking direction. If the user wishes to further reduce the drag from the one-way brake 212 while raising the movable rail 206, he may push in on the plunger 250 while raising the rail 206. The one-way brake 212 may be located anywhere along the length of the movable rail 206 that is convenient to the user. This schematic shows the brake 212 located near the right end of the movable rail 206, but it could be located near the left end, near the center, or in any other convenient location as long as the housing 244 of the brake 212 is fixed relative to the rail 206.

To summarize, FIG. 2 shows a horizontal cording arrangement with the addition of a one-way brake 212 so that the guide cables 202, 204 are in a taut condition but are not taut enough to rely on system friction to hold the movable rail 206 in place, making it easier to raise and lower the shade 200*.

Figure 3:
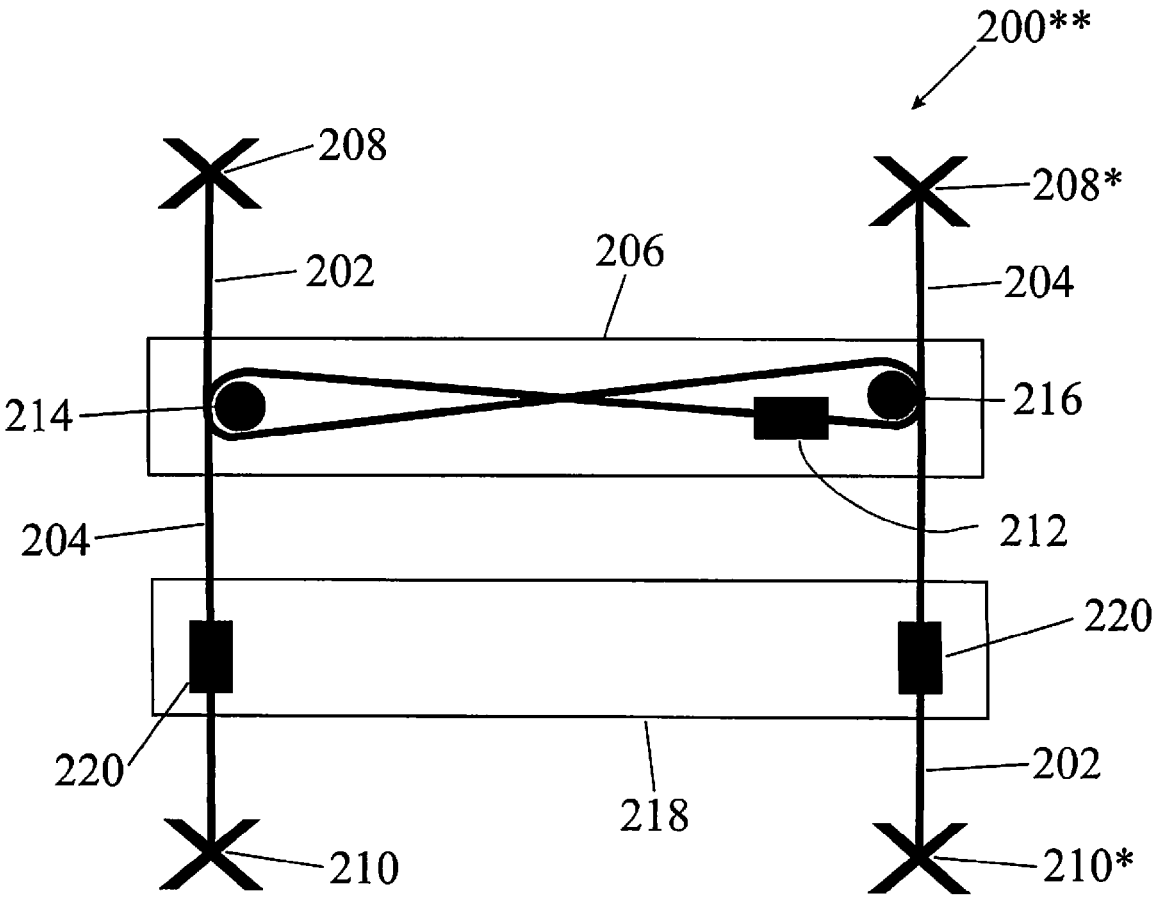
FIG. 3 is a schematic, similar to FIG. 2, but with a second movable rail moving along the same two cords, and including additional brakes to hold the second movable rail in place.

FIG. 3 shows a shade 200 which is similar to the shade 200* of FIG. 2, but which has a second movable rail 218 added below the first movable rail 206. This second movable rail 218 has one-way brakes 220 at each end of the rail, which are identical to the one-way brake 212. Each of the one-way brakes 220 serves as a guide bearing where it receives its respective cable 202, 204. The one-way brakes 220 are oriented so they do not interfere with raising the second movable rail 218 but prevent the second movable rail 218 from falling. When a user wants to lower the second movable rail, he engages an actuator which disengages the brakes 220 and preferably does so with a control that disengages both brakes 220** simultaneously.

There is no mechanism to ensure that the second movable rail 218 remains horizontal or parallel to the first movable rail 206. The position of the second movable rail 218 is independent of the position of the first movable rail 206, except that the second movable rail 218 always remains below the first movable rail 206.

This covering arrangement 200 is suitable for operation as a top-down/bottom-up shade. To use it as a top-down/bottom-up shade, a covering material (not shown) extends from the first movable rail 206 to the second movable rail 218. The first movable rail 206 operates exactly in the same manner as the movable rail 206 in the shade 200* of FIG. 2. It may be raised by pushing up anywhere along the length of the movable rail 206, and it may be lowered by disengaging the one-way brake 212 and pushing down anywhere along the length of the movable rail 206. The second movable rail 218** is raised by pushing up on it, and it is lowered by disengaging the one-way brakes 220 to release their braking action and then pushing down on the second movable rail 218. It is preferred for the user to grab the second movable rail 218 near the midpoint of the length of the second movable rail 218 when raising and lowering that rail in order to avoid skewing the second movable rail 218 and to keep it horizontal and parallel to the first movable rail 206.

Figure 4:
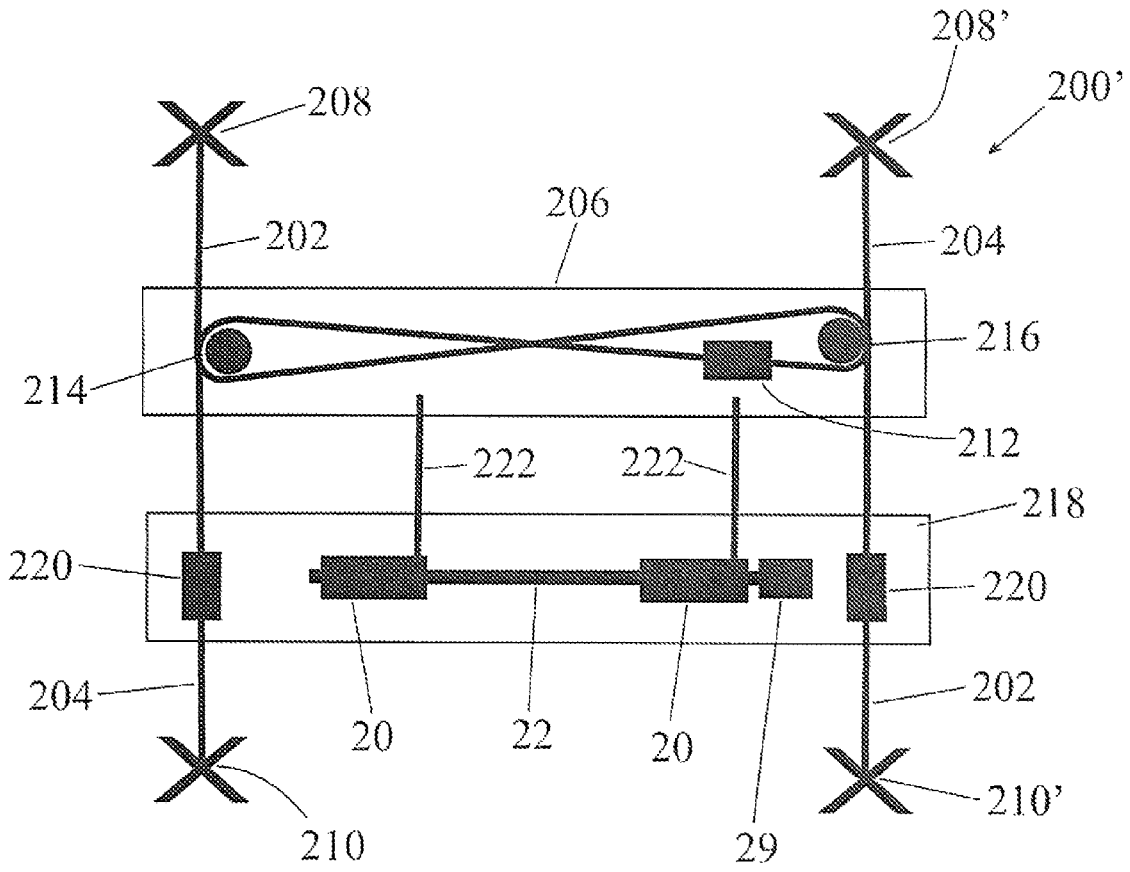
FIG. 4 is a schematic, similar to FIG. 3, but with the addition of powered lift stations to aid in keeping the second movable rail parallel to the first movable rail.

FIG. 4 shows a shade 200' which is similar to the shade 200 of FIG. 3, but has a take-up system to force the second movable rail 218 to remain parallel to the first movable rail 206. In this instance, the take-up system includes two lift stations 20 (which include lift spools) and a spring motor 29 functionally interconnected by the lift rod 22. These lift stations 20 and spring motor 29, and their operating principles are disclosed in U.S. Pat. No. 6,536,503 "Modular Transport System for Coverings for Architectural Openings", issued Mar. 25, 2003, which is hereby incorporated herein by reference. Very briefly, the lift rod 22 is rotationally connected to an output spool on the spring motor 29. A flat spring (not shown) in the spring motor 29 has a first end connected to the output spool (having a first axis of rotation) of the spring motor 29. The second end of the flat spring in the spring motor 29 is either connected to a storage spool (not shown) having a second axis of rotation, or is coiled about an imaginary axis defining this second axis of rotation. The flat spring is biased to return to its "normal" state, wound around the second axis of rotation, and typically this corresponds to when the movable rail 218 is in the fully raised position (retracted). As the movable rail 218 is pulled down (extended) the flat spring unwinds from the second axis of rotation and winds onto the output spool, increasing the potential energy stored in the spring. When the movable rail 218 is raised (retracted) the spring winds back onto the storage spool, using some of the potential energy to assist the user in raising the movable rail 218 by rotating the output spool and thus the lift rod 22 connected to the output spool of the spring motor 29**.

Of course, a spring motor with drag brake may be used instead of the combination of just the spring motor 29 and the two simultaneous one-way brakes 220 for the same end result. An example of a spring motor with drag brake is disclosed in U.S. Pat. No. 7,740,045 "Spring Motor and Drag Brake for Drive for Coverings for Architectural Openings", issued Jun. 22, 2010, which is hereby incorporated herein by reference. The spring motor 29 (or spring motor with drag brake) keeps tension on the lift cables 222 that extend between the first movable rail 206 and the second movable rail 218 and through the slats, pleated shade, or other covering material. Since the two (or more) lift stations 20 are driven together by the same lift rod 22, they wind up and unwind the same amount of lift cable 222, which prevents the second movable rail 218 from skewing and keeps the second movable rail 218 parallel to the first movable rail 206.

Figure 5:
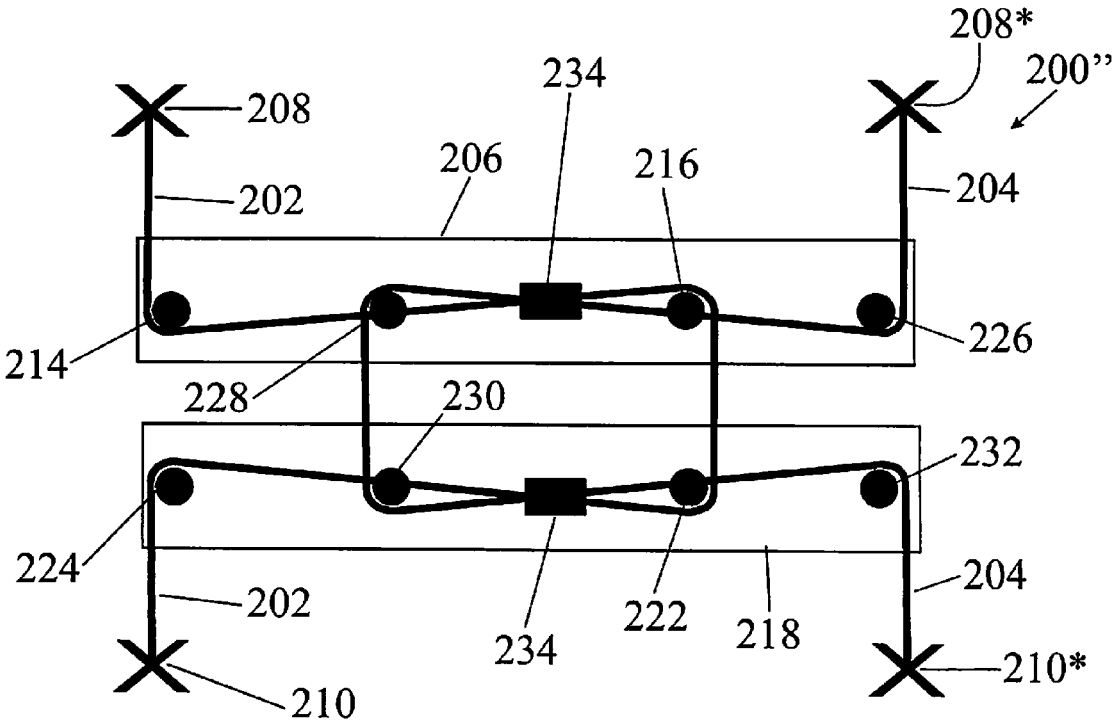
FIG. 5 is another alternative schematic of two movable rails moving along two fixed cords, including double one-way brakes to assist in keeping the movable rails horizontally aligned and parallel to each other.

As shown in FIG. 5, in the parallel cording arrangement, a first cable 202 is secured at its first end to a point 208 at the upper left of the opening, goes under a bearing support 214 on the left end of the first movable rail 206, crosses over to the right side of the first movable rail 206 along the first movable rail 206, passing through a one-way brake 234 and then over a second bearing support 216 on the right of the first movable rail 206, then extends down to the second movable rail 218, passing under a third bearing support 222 on the right of the second movable rail 218, then crosses over to the left side of the second movable rail 218, passing through a second one-way brake 234, then over a fourth bearing support 224 on the left end of the second movable rail, and is then secured at its second end to a point 210 at the lower left of the opening.

A second cable 204 follows a mirror image of this cording arrangement. Its first end is secured to a point 208* at the upper right of the opening. It then passes under a bearing support 226 on the right end of the first movable rail 206, through a one-way brake 234, over a bearing support 228 on the left of the first movable rail, down to the second movable rail 218, under a bearing support 230 on the left of the second movable rail 218, through a one-way brake 234, over a bearing support 232 on the right end of the second movable rail, and its second end is secured to a fixed point 210* at the bottom right of the opening. The bearing supports 226, 228, 230, 232 for the second cable 204 are separate from the bearing supports 214, 216, 222, 224 for the first cable 202. Also, the one-way brakes 234 for the first cable are separate from the one-way brakes 234 for the second cable, but the one-way brakes 234 on the first movable rail 206 have a single button, lever or other actuator that disengages them both at the same time, and the same is true of the one-way brakes 234 on the second movable rail 218.

As with the previous embodiment, the one-way brakes 234 are arranged so they do not engage to interfere with the user raising the respective movable rail 206 or 218, but they act to prevent their respective rail from falling. When the user wants to lower the respective movable rail 206 or 218, he pushes a button or lever or other actuator to disengage the one-way brakes 234 for that respective movable rail and then pushes down on the rail. (As was explained earlier with respect to another embodiment, it would be possible to use a two-way brake instead of a one-way brake, and, in that case, the user also would have to push the button or lever or other actuator to disengage the brakes to raise the rail.)

If the brakes 234 were not present, this cording arrangement would ensure that the first and second horizontal movable rails 206, 218 would be parallel to each other. By adding the brakes 234, this arrangement ensures that the first and second movable rails 206, 218 remain both parallel and horizontal.

Referring to FIG. 5 and assuming that the brakes 234 are not present, if a user were to push down on the left side of the first movable rail 206, causing the bearing support 214 to move downwardly and the first movable rail 206 to skew, then, since the cord 202 is in a taut condition and is fixed at both ends to fixed points, the increase in the amount of cord 202 above the bearing support 214 has to be compensated for by a decrease in the amount of cord below the bearing support 214. This means that the second movable rail 218 also will skew, so that it remains parallel to the first movable rail 206.

If the user only moves one of the movable rails 206, 218 at a time, the bearing supports on the movable rail that remains stationary function as if they were the fixed end points in a horizontal cording arrangement (as explained in more detail below), thereby ensuring that the movable rail that is being moved remains parallel to the movable rail that is remaining stationary. Thus, if the rail that is remaining stationary is horizontal, then this parallel cording arrangement will ensure that the moving rail also will be horizontal.

Looking at FIG. 5 and assuming that the first movable rail 206 remains stationary, then from the point of view of the second movable rail 218, it is in a horizontal cording arrangement like the arrangement of FIG. 2. The cable 202 is fixed at the bearing support 216 on the first movable rail 206, which then provides the same function as the upper right fixed point 208* of the horizontal cording embodiment of FIG. 2, and the cable 204 is fixed at the bearing support 228 of the first movable rail 206, which then provides the same function as the upper left fixed point 208 of the horizontal cording embodiment of FIG. 2.

Thus, in FIG. 5, when the first movable rail 206 is stationary, the cable 202 extends down from its top right anchoring point 216, goes under the bearing support 222, crosses over to the other side of the second movable rail 218, goes over the bearing support 224 and extends down to its bottom left anchoring point 210 on the opposite side of the window opening from the top anchoring point 216. The other cable 204 follows a mirror image routing of the first cable 202, extending downwardly from the upper left fixed anchor point 228, under the bearing support 230, across the movable rail 218, over the bearing support 232, and then down to the lower right anchor point 210*. This is a horizontal cording arrangement with respect to the second movable rail 218. This means that the second movable rail 218 will behave as if it is in a horizontal cording arrangement relative to the first movable rail 206 (which in fact it is), and it will remain parallel to the first movable rail 206. If the first movable rail 206 is horizontal and is not moved by the user, then the cording arrangement ensures that the second movable rail 218 remains horizontal (parallel to the first movable rail 206) as the second movable rail 218 is moved by the user.

Similarly, if the situation is reversed and the second movable rail 218 is stationary while the first movable rail 206 is moved by the user, then the bearing supports 230, 222 of the second movable rail 218 function as the left and right lower fixed supports for the first movable rail 206, so the cording will keep the first movable rail 206 parallel to the stationary second movable rail 218 as the user moves the first movable rail 206.

As in the embodiment of FIG. 2, the one-way brakes 234 allow the operator to raise each movable rail 206 or 218 without having to disengage the brakes 234. The one-way brakes 234 prevent the rails from falling when they are released by the user, and the user actuates a button, lever, or other actuator to disengage the one-way brakes 234 on a movable rail and pushes down on that rail in order to move that respective movable rail downwardly.

If the two rails 206, 218 become skewed relative to the architectural opening, it is a simple matter for the user to run both of the movable rails 206, 218 to the top or bottom of the opening to get them reoriented into the horizontal direction. The covering material in the arrangement of this shade 200" typically extends between the two movable rails 206, 218, the cords 202, 204 can pass through the covering material, and the covering can be extended and retracted without blowout (fabric stabilization). Only one cable (one cable at each end of the covering 200") is exposed and this cable is advantageously located at the end of the shade, hugging the jamb, for safety.

Figure 6:
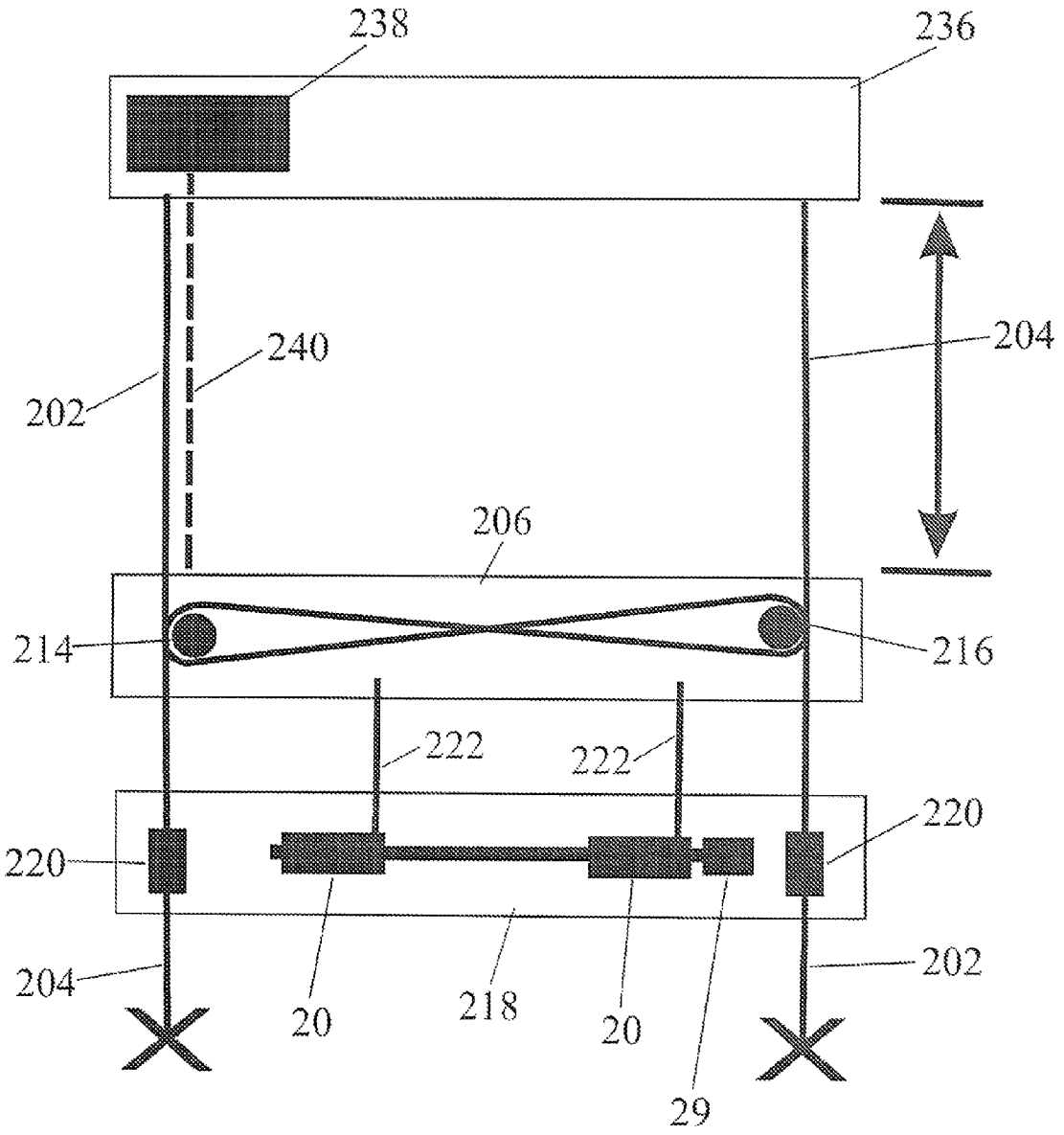
FIG. 6 is a schematic similar to FIG. 4, but with the addition of a lifting mechanism in the head rail.

The embodiment of FIG. 6 is the same as the arrangement shown in FIG. 4, except that a headrail 236 has been added, and a lift control mechanism 238 and lift cord 240 have been added. The lift control mechanism 238 is housed in the headrail 236, and the lift cord 240 extends down from the headrail to the first movable rail 206. The lift control mechanism 238 may be any device which causes a spool to rotate, such as a remote-controlled electric motor, for instance. A single lift cord 240 extends from the lift control mechanism 238 to the first movable rail 206. This lift cord 240 is the only moving cord; the other cables 202, 204 are anchored at their respective ends so they do not move. Of course, the lift control mechanism 238 may be housed in the first movable rail 206 instead of in the top rail 236, in which case the top rail 236 may not be needed as the upper end of lift cord 240 could be anchored directly to the frame of the window opening.

The cording in this embodiment puts the first movable rail 206 in a horizontal cording arrangement, so it always remains horizontal. Thus, the lift cord 240 can be secured to the first movable rail 206 at any point along the first movable rail 206, such as at the left end, as shown here. When the lift cord 240 starts retracting, it pulls up on the first movable rail 206. If desired, a sleeve (not shown) may be placed over the lift cord 240 and over the portion of the cable 202 above the first movable rail 206 to enclose them together into a single sleeve. The sleeve should collapse and expand as the first movable rail 206 moves up and down. An accordion style sleeve is one example of a type of sleeve that would be suitable for this application.

The lift control mechanism 238 and lift cord 240 could be added to many of the previous embodiments as well, such as the embodiments of FIGS. 2, 3, and 5.

It should be noted that a covering material (not shown) may be connected to and extend between a fixed top rail (or the top of the opening) and the first movable rail 206; a covering material may be connected to and extend between the first and second movable rails 206, 218, and a covering material may be connected to and extend between the second movable rail 218 and a fixed bottom rail (or the bottom of the opening). And there may be any combination of such coverings.

It will be obvious to those skilled in the art that modifications may be made to the embodiments described above without departing from the scope of the present invention as claimed.

What is claimed is:

1. A covering for an architectural opening, comprising:

a first horizontal movable rail defining left and right ends and a midpoint midway between the left and right ends;

an extendable covering material connected to said first horizontal movable rail, wherein movement of said first horizontal movable rail upwardly and downwardly extends and retracts the extendable covering material;

a first taut cable having an upper first cable end fixed at a first fixed point located above said first horizontal movable rail and offset to the left of an imaginary vertical line extending through the midpoint of said first horizontal movable rail and having a lower first cable end fixed at a second fixed point located below said first horizontal movable rail, wherein there is no elastic tensioning member to keep said first cable taut between said first and second fixed points, said first cable extending from said first fixed point, beneath a first guide bearing on the left of said first horizontal movable rail, over a second guide bearing on the right of said first horizontal movable rail, and thereafter to said second fixed point;

a second taut cable having an upper second cable end fixed at a third fixed point located above said first horizontal movable rail and offset to the right of the imaginary vertical line and having a lower second cable end fixed at a fourth fixed point located below said first horizontal movable rail, wherein there is no elastic tensioning member to keep said second cable taut between said third and fourth fixed points, said second taut cable extending from the third fixed point, beneath a third guide bearing on the right of said first horizontal movable rail, over a fourth guide bearing on the left of said first horizontal movable rail, and thereafter to said fourth fixed point; and a first brake mounted on said first horizontal movable rail, wherein said first brake applies a braking force only to one of said first and second taut cables in order to stop both of said first and second taut cables from moving along the respective guide bearings on said first horizontal movable rail in at least one direction, wherein there is no brake on said first horizontal movable rail which applies a braking force to the other of said first and second taut cables; wherein said first and second taut cables are taut enough to keep the first horizontal rail in a horizontal position as the first horizontal rail moves upwardly and downwardly but are not taut enough to hold the first horizontal rail in place without using said brake; and wherein there is no biasing member to assist with keeping the first horizontal movable rail in a horizontal position while raising and lowering the first horizontal movable rail.

2. A covering for an architectural opening as recited in claim 1, wherein one of said second and fourth fixed points is offset to the left of the imaginary vertical line and the other of said second and fourth fixed points is offset to the right of the imaginary vertical line.

3. A covering for an architectural opening as recited in claim 2, wherein said first brake is a one-way brake, which provides substantially greater resistance to movement of the respective taut cable in a first direction along the guide bearings and substantially less resistance to movement of the respective taut cable in the opposite direction along the guide bearings, wherein the greater resistance in the first direction stops the first movable horizontal rail from falling and the substantially less resistance permits the first movable horizontal rail to be easily raised.

4. A covering for an architectural opening as recited in claim 2, and further comprising a second horizontal movable rail located below said first horizontal movable rail and including fifth and sixth guide bearings, wherein said fifth guide bearing receives said first taut cable and said sixth guide bearing receives said second taut cable, for movement of said second horizontal movable rail up and down, and wherein said second and fourth fixed points are located below said second horizontal movable rail.

5. A covering for an architectural opening as recited in claim 4, and further comprising at least one brake on said second movable horizontal rail which acts to stop one of said first and second taut cables from moving along said second horizontal movable rail in at least one direction so as to stop the second movable horizontal rail from falling.

6. A covering for an architectural opening as recited in claim 1, wherein one of said second and fourth fixed points is offset to the left of the imaginary vertical line and the other of said second and fourth fixed points is offset to the right of the imaginary vertical line; and further comprising a second horizontal movable rail located below said first horizontal movable rail and including fifth and sixth guide bearings, wherein said fifth guide bearing receives said first taut cable and said sixth guide bearing receives said second taut cable, for movement of said second horizontal movable rail up and down, and wherein said second and fourth fixed points are located below said second horizontal movable rail; and further comprising first and second lift spools mounted on one of said first and second movable horizontal rails; and first and second lift cords secured to the other of said first and second movable horizontal rails and extending to the first and second lift spools, respectively.

7. A covering for an architectural opening as recited in claim 6, and further comprising a motor mounted on said one of said first and second movable horizontal rails which drives at least one of said first and second lift spools.

8. A covering for an architectural opening as recited in claim 6, and further comprising an upper lift cord extending downwardly to said first movable rail; and a lift mechanism including means for extending and retracting said upper lift cord to raise and lower the first movable horizontal rail.

9. A covering for an architectural opening, comprising:

a first horizontal movable rail defining left and right ends and a midpoint midway between the left and right ends;

an extendable covering material connected to said first horizontal movable rail, wherein movement of said first horizontal movable rail upwardly and downwardly extends and retracts the extendable covering material;

a first taut cable having an upper first cable end fixed at a first fixed point located above said first horizontal movable rail and offset to the left of an imaginary vertical line extending through the midpoint of said first horizontal movable rail and having a lower first cable end fixed at a second fixed point located below said first horizontal movable rail, wherein there is no elastic tensioning member to keep said first cable taut between said first and second fixed points, said first cable extending from said first fixed point, beneath a first guide bearing on the left of said first horizontal movable rail, over a second guide bearing on the right of said first horizontal movable rail, and thereafter to said second fixed point;

a second taut cable having an upper second cable end fixed at a third fixed point located above said first horizontal movable rail and offset to the right of the imaginary vertical line and having a lower second cable end fixed at a fourth fixed point located below said first horizontal movable rail, wherein there is no elastic tensioning member to keep said second cable taut between said third and fourth fixed points, said second taut cable extending from the third fixed point, beneath a third guide bearing on the right of said first horizontal movable rail, over a fourth guide bearing on the left of said first horizontal movable rail, and thereafter to said fourth fixed point; and a first brake mounted on said first horizontal movable rail, wherein said first brake acts to stop one of said first and second taut cables from moving along the respective guide bearings on said first horizontal movable rail in at least one direction, wherein one of said second and fourth fixed points is offset to the left of the imaginary vertical line and the other of said second and fourth fixed points is offset to the right of the imaginary vertical line, and further comprising a second horizontal movable rail below said first horizontal movable rail, wherein said second and fourth fixed points are located below said second horizontal movable rail;

wherein said first taut cable extends from said second guide bearing on the right of said first horizontal movable rail, below a fifth guide bearing on the right of said second horizontal movable rail, over a sixth guide bearing on the left of said second horizontal movable rail, and then to said second fixed point, and said second taut cable extends from said fourth guide bearing on the left of said first horizontal movable rail, below a seventh guide bearing on the left of said second horizontal movable rail, over an eighth guide bearing on the right of said second horizontal movable rail and then to said fourth fixed point, and wherein each of said first and second horizontal movable rails has a first brake which stops relative movement between the first taut cable and the respective horizontal movable rail in at least one direction and a second brake which stops relative movement between the second taut cable and the respective horizontal movable rail in at least one direction.

10. A covering for an architectural opening as recited in claim 9, wherein said first and second brakes are one-way brakes arranged to stop the respective rail from falling.

* * * * *